United States Patent [19]

Slavik et al.

[11] Patent Number: 4,922,704

[45] Date of Patent: May 8, 1990

[54] METHOD AND APPARATUS FOR INTRODUCING A ROVING INTO A TEXTILE MACHINE DRAFTING FRAME

[75] Inventors: Walter Slavik, Horgen; Arthur Wuermli, Winterthur, both of Switzerland

[73] Assignee: Rieter Machine Works, Ltd., Winterthur, Switzerland

[21] Appl. No.: 253,146

[22] Filed: Oct. 4, 1988

[30] Foreign Application Priority Data

Oct. 8, 1987 [CH] Switzerland ..... 03946/87

[51] Int. Cl.[5] ..... D01H 13/04; D01H 13/14

[52] U.S. Cl. ..... 57/261; 19/0.25; 57/81

[58] Field of Search ..... 57/261, 266, 267, 268, 57/269, 315, 78, 80, 81, 85, 352; 19/0.25, 239, 246, 286, 287, 288

[56] References Cited

U.S. PATENT DOCUMENTS

| | | | |
|---|---|---|---|
| 3,832,839 | 9/1974 | McClure | 57/315 X |
| 4,592,114 | 6/1986 | Stahlecker | 19/288 |
| 4,630,434 | 12/1986 | Hartsmanngruber et al. | 19/0.25 |
| 4,727,713 | 3/1988 | Konig et al. | 57/81 X |

*Primary Examiner*—Donald Watkins
*Attorney, Agent, or Firm*—Kenyon & Kenyon

[57] ABSTRACT

According to the method, an end part of a roving is first introduced into the main drafting zone of a drafting frame of a textile machine after a reference point at a clamping device. Thereafter, a middle part of the roving is drawn laterally into the preliminary drafting zone solely by the tension of the main drafting zone. The apparatus comprises a gripper which is connected via a pivotable arm or a telescopic arm to a mobile or stationary robot which can cooperate either with a pusher, a spacer or a fixed slider.

15 Claims, 3 Drawing Sheets

29
2
52
59
60
50
56
54
28
55
57
34
33
38
37
60
52
50
2.3
2.1
2.2
20
25
17
26
43
41
27
IV
IV
47
15
3
40
38.1
21
22
16
23
4
86
85
84
88
50
89
17
20
26
27
18

METHOD AND APPARATUS FOR INTRODUCING A ROVING INTO A TEXTILE MACHINE DRAFTING FRAME

This invention relates to a method and apparatus for introducing a roving into a textile machine drafting frame.

As is known, isolated yarn breakages frequently recur in textile machines with drafting frames, and operatives or automatic equipment are required to rectify such breakages. Obviously, this work should be completed in the shortest possible time in order to reduce staff or so that the automatic equipment can clear more yarn breakages during the same time.

U.S. Pat. No. 3,832,839 discloses a technique whereby such repair work can be reduced. As described, after a yarn breakage has been detected, a clamping device which precedes the drafting frame and a laterally slotted trumpet is activated to sever the roving (this term also being used herein to denote a slubbing or sliver generally) at a clamping point. An operative then unlocks the clamping device and, using both hands, passes a central part of the roving simultaneously through the slot in the trumpet and between top and bottom feed rolls of the drafting frame. As a result, by a manual movement, the end of the roving comes into a position between the feed rolls and the central rolls in a preliminary drafting zone of the drafting frame. This does away with the time required for introducing the roving end into the trumpet opening , which is often difficult to access. Also, since the roving end is already partly situated in the preliminary drafting zone, the waiting time until the drawn roving—now a yarn—appears at the drafting frame outlet, is reduced.

However, after introduction of the roving between the feed rolls, there is no guarantee that the roving end actually passes between the central rolls unless the operative intervenes again. If this guaranteed engagement is required, a waiting time will be necessary until the roving end reaches the central rolls and, secondly, an actuation time will be required for this new intervention, although the waiting time is too short to remedy a yarn breakage at an adjacent drawing or spinning station. Furthermore, the need for two hands renders automation difficult or expensive, since two simultaneously moving robot arms must be coordinated in their movements.

Attempts to automate the introduction of a roving into the drafting frame are disclosed in Japanese Patent No. 56-43130, in which a rockable suction tube first brings the roving end through a lateral slot in a roving guide disposed displaceably laterally of the drafting frame rolls and then laterally adjacent the drafting frame rolls. Thereafter, the roving guide introduces the roving between the feed rolls by displacement. According to another embodiment, the lateral introduction between the feed rolls can also be effected by a bent pressure arm. There is neither a description nor indication of how the roving can pass automatically into the main drafting zone and be conveyed on correctly from there.

Accordingly, it is an object of the invention is to enable yarn breakages in drafting frames to be remedied more rapidly and more reliably with relatively simple mechanical means.

It is another object of the invention to reduce the down-time for correcting yarn breakages in drafting frames of a textile machine.

Briefly, the invention provides a method and apparatus for introducing a roving into a textile machine drafting frame.

In accordance with the method, an end part of the roving is taken up at a reference point upstream of a drafting frame having a preliminary drafting zone and a downstream main drafting zone and is thereafter introduced into the main drafting zone while bypassing about the preliminary drafting zone. Thereafter, the roving is drawn into the main drafting zone while tension is imparted in the roving upstream of the main drafting zone in order to cause a lateral introduction of the roving into the preliminary drafting zone.

In one embodiment, the end part of the roving can bypass a top feed roll of the preliminary drafting zone laterally during movement from the reference point to the main drafting zone. In this embodiment, after the end part of the roving is taken up in the main drafting zone, the remainder of the roving moves laterally into the preliminary drafting zone, that is, under the top feed roll.

In another embodiment, the end part of the roving can be moved over the outer surface of the top feed roll of the preliminary drafting zone while the remainder of the roving is brought to the side of the top feed roll. The subsequent lateral introduction of the roving into the preliminary drafting zone then occurs automatically after bringing of the roving to the side of the top feed roll.

The invention also provides a textile machine which is comprised of at least one drafting frame having a preliminary drafting zone including at least one top feed roll and a bottom feed roll as well as a main drafting zone. In addition, the machine includes a clamping device for positioning an end part of the roving at a reference point upstream of a drafting frame, a sensor for emitting a signal in response to a break in the roving delivered from the drafting frame and a robot which is responsive to the signal from the sensor. In accordance with the invention, the robot includes a gripper to engage the end part of the roving at the reference point and a movable arm connected to the gripper in order to move the gripper between the reference point and the central discharge point immediately upstream of the main drafting zone. In addition, a means is provided for feeding the roving between the reference point and the discharge point to a free end face of the top feed roll.

In one embodiment, the arm of the robot is movable in three-dimensions while the means for feeding the roving to the free-end face of the top feed roll is in the form of a spacer. This spacer is situated adjacent the free-end face of the top feed roll in the path of movement of the gripper from the reference point to the discharge point for engagement of the roving on the spacer. The robot is also connected with the spacer in order to transmit a triggering signal to the spacer for the release of the roving in response to introduction of the end part of the roving into the main drafting frame. Suitably, the spacer is a pivotly mounted hook which is movable between a blocking position to hold the roving space from a top feed roll and a release position to permit the roving to move to the top feed roll.

In another embodiment, the arm of the robot is pivotly moveable in two-dimensions in order to pass the gripper over the outer surface of the top feed roll during movement from a reference point to a discharge point. In this case, the means for feeding the roving to the top feed roll is in the form of a pusher for feeding the roving laterally to the top feed roll. In addition, the robot is connected to the pusher in order to activate the pusher in response to the introduction of the end part of the roving into the main drafting frame. By way of example, the pusher may be in the form of a rockable stirrup having a pair of curved limbs for selective sliding of a roving thereon.

In still another embodiment, the means of feeding the roving to the top feed roll may be in the form of a fixed slider. In this case, the slider is positioned for sliding of the roving thereon and therefrom laterally to the free-end face of the top feed roll after the introduction of the end part of the roving into the main drafting zone.

Since the end part of the roving is introduced directly into the main drafting zone, reliable engagement of the roving is guaranteed. This is possible without unproductive waiting times and without any additional operation so that the entire operation can be performed more quickly. The time that the roving requires to reach the main drafting zone is thus reduced to zero so that the drawn roving or yarn becomes visible even more rapidly at the end of the drafting frame and can be pieced up more rapidly. The residence time of the roving end in the main drafting zone until piecing up is sufficient to enable work to be performed in the immediate vicinity.

The taking up or engagement of the roving end or roving end portion and its introduction into the main drafting zone can be effected extremely simply by means of one hand or a single robot arm. With a robot gripper even difficult to access places can be reached, for example, the place between a trumpet for guarding the roving and a feed roll pair of the preliminary drafting zone. In this case, the trumpet can be moved from near the feed roll pair to such an extent sufficient space is created for the gripper. Further, it would be advantageous for a traversing bar stroke to be increased so that the rolls can wear uniformly.

An existing mobile robot can be inexpensively adapted to perform the method described above. In this case, the cost should be modest should a stationary telescopic rod be used as an arm of the robot.

In accordance with the invention, the end part of the roving is taken up at a reference point situated between the drafting zone and a trumpet for guiding the roving to the preliminary drafting zone. This simplifies the overall structure since there is no need for a lateral introduction of the roving into the trumpet.

Where the roving is automatically introduced into the preliminary drafting zone by using the tension exerted by the main drafting zone, a single two-dimensional movement can be used so that the robot can be simplified in terms of control technology.

The feature of passing the roving end about a spacer laterally of the feed rolls of the preliminary drafting zone prevents the roving from being prematurely entangled in the feed rolls during the lateral bypassing movement.

The use of a fixed slider to bring the roving to the free-end face of the top feed roll eliminates the need for movable parts and controlled devices for such parts, except for the arm of the robot. This has a favorable effect on manufacturing costs and the possibility of a malfunction.

The clamping device of the machine may also be constructed as a trumpet-shaped guide for guiding of the roving there through. This enable the gripper travel to be reduced.

The clamping device may alternatively include a trumpet-shaped guide having a longitudinally disposed slot for passage of the roving laterally therethrough as well as a tab which extends tangentially over the slot at an upstream end. This permits a convergent trumpet-shape to be maintained in order to compress the roving as well as a lateral inlet. In addition, the mechanical movement of the robot arm can easily engages the roving.

The embodiment which employs a pivotally mounted hook for holding the roving laterally of the feed rolls saves on space, is economic and does not obstruct the surrounding environment.

In the case where the pusher is in the form of a rockable stirrup having a pair of curved limbs, the roving can be simultaneously engaged at two places and be satisfactorily displaced.

These and other objects and advantages of the invention will become more apparent from a following detailed description taken in conjunction with the accompanying drawings wherein:

FIG. 1 diagrammatically illustrates a side elevation of a textile machine in which a clamping device is integrated with a trumpet and a mobile robot carriage is used in accordance with the invention;

FIG. 2 diagrammatically illustrates a plan view of the machine of FIG. 1 through section II—II, in which a modified clamping device is used;

Figures 2, 3, 7:
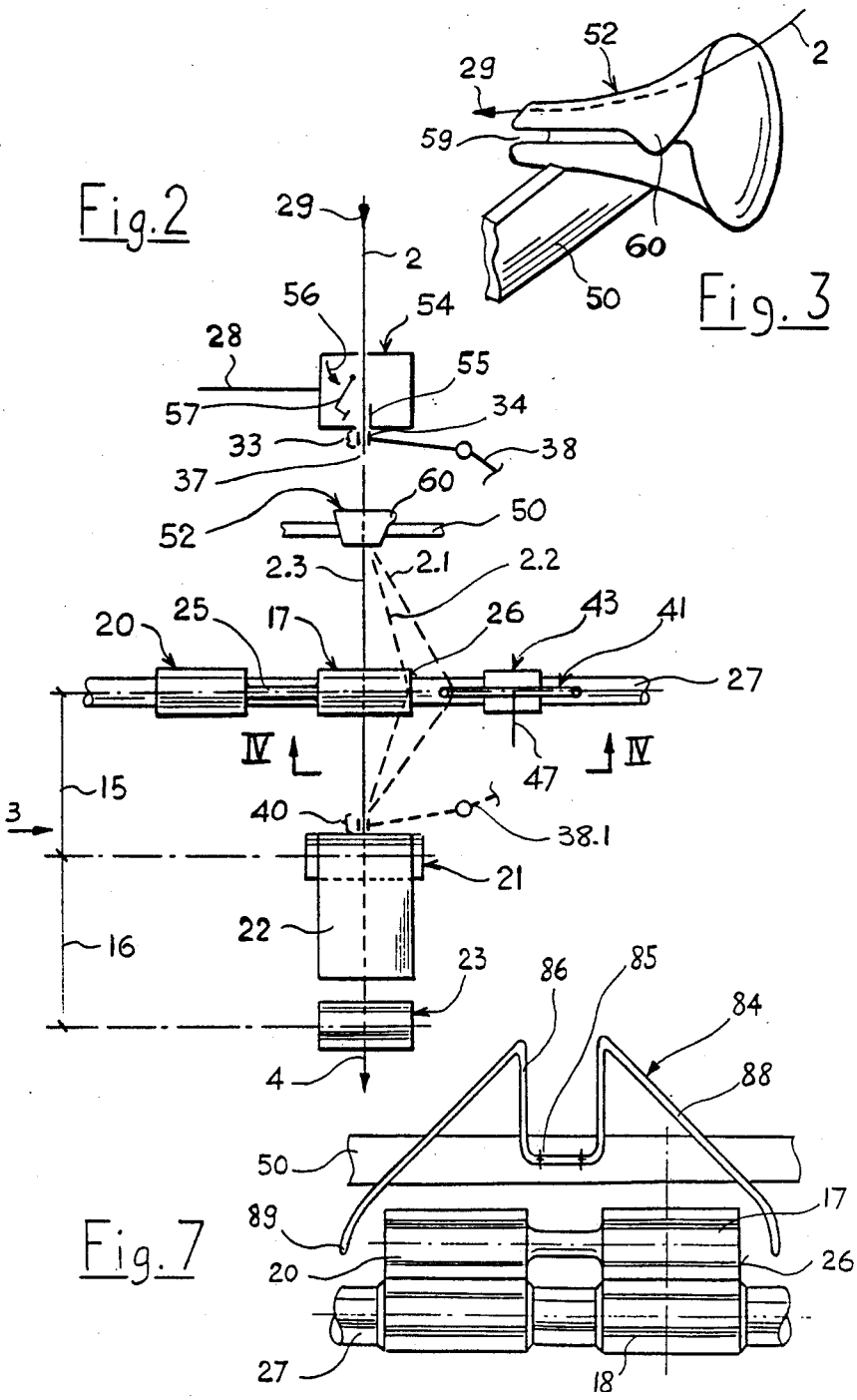
FIG. 3 illustrates a perspective view of a trumpet used in the embodiment of FIG. 2.
Figure 6:
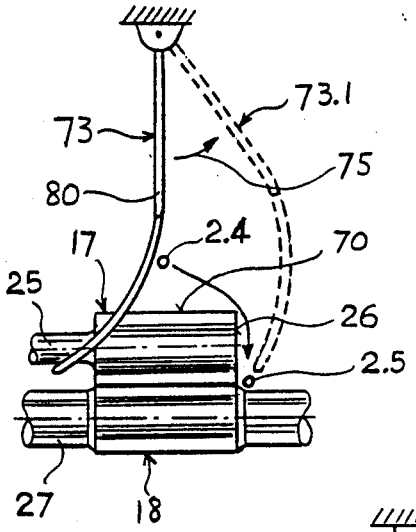
Figure 5:
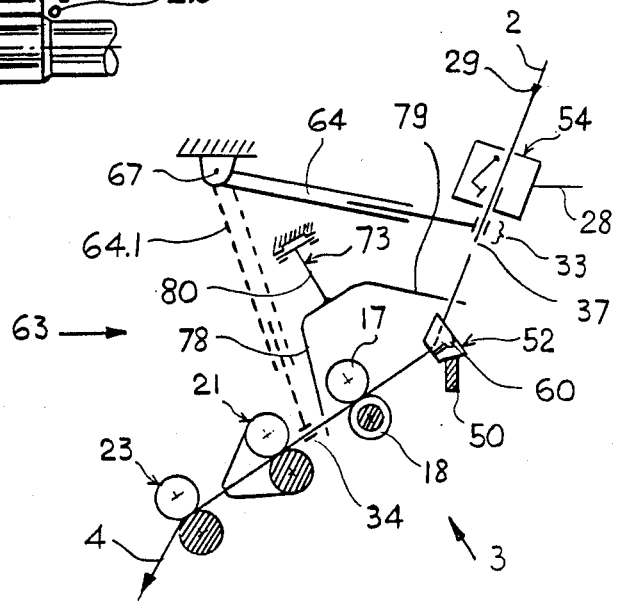

FIG. 5 diagrammatically illustrates a side elevation of a textile machine employing a pusher to move a roving to a top feed roll;

FIG. 6 illustrates a front elevation of the pair of feed rolls with a pusher stirrup in accordance with the invention; and FIG. 7 illustrates a perspective plan view of a pair of feed rolls and a traversing bar together with a fixed sliding stirrup in accordance with the invention.

Figure 1:
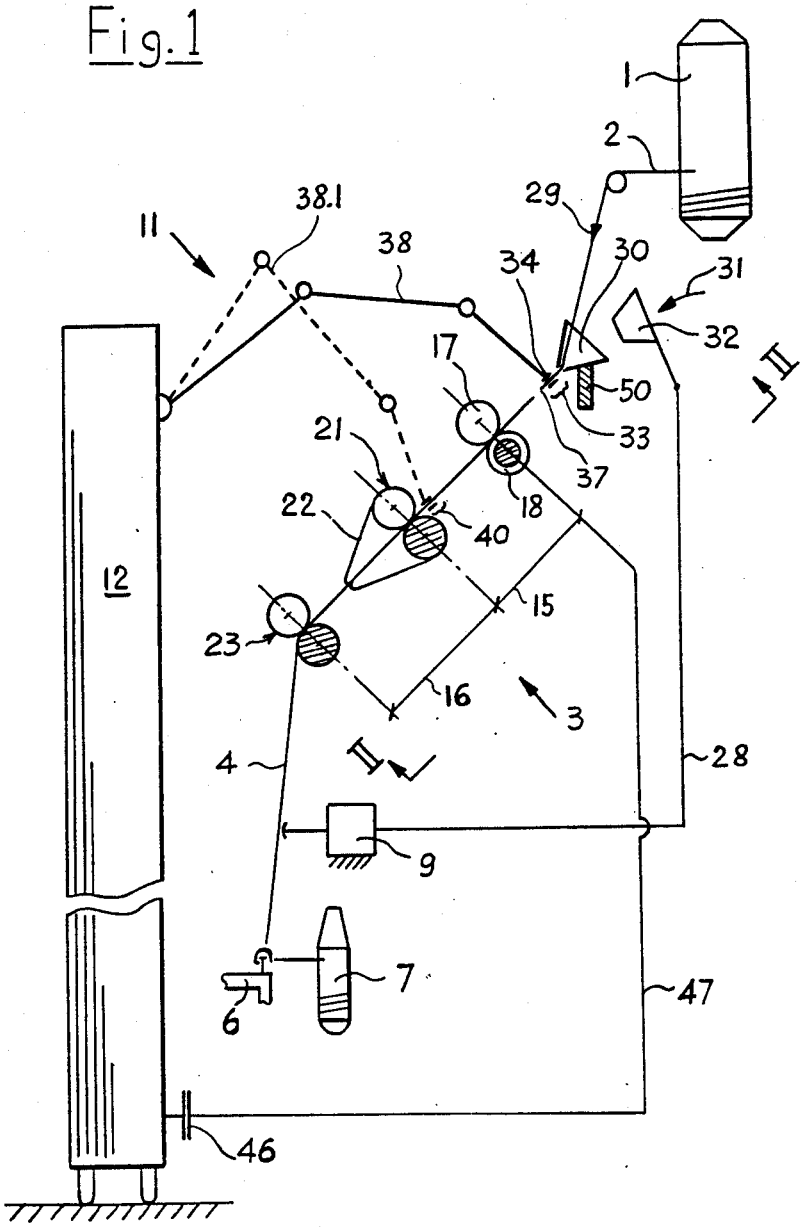

Referring to FIG. 1, the textile machine, for example, a spinning station, is supplied with a roving or slubbing 2 which is drawn from a roving bobbin 1 and drafted by means of a drafting frame 3 of the machine. The drafted roving, now termed yarn 4, passes over a ring rail 6 and is wound on a yarn bobbin 7 or cop. A stationary sensor 9 is associated with each textile machine to monitor the yarn 4 to ensure that the yarn is present.

The textile machine also employs a robot which has a carriage 12 which is movable on rails or on the floor parallel to the longitudinal direction of the adjacent drafting frames and can carry out the various operating and/or monitoring functions. Instead of individual sensors, the sensor 9 may be located on the carriage 12 for successively monitoring the yarns at the different spinning stations.

The drafting frame 3 is in known manner, divided into a preliminary drafting zone 15 in which the roving is drawn only slightly, and a main drafting zone 16 in which the roving fibers are greatly attenuated to the correct size. The preliminary drafting zone 15 is bounded by at least one pair of feed rolls, i.e. a top feed roll 17 and a bottom feed roll 18, and a middle pair of rolls 21 usually provided with tapes 22. Two pairs of feed rolls may also be used. The main drafting zone 16 extends between the middle pair of rolls 21 and a pair of delivery rolls 23. The top rolls in each case of two adjacent spinning stations are combined as usual in a common mounting (not shown), this being indicated only by the top feed roll 20 in FIG. 2, which is associated with and connected to the adjacent spinning station by means of a common shaft 25. As indicated in FIG. 2, the free end face of the top feed roll is spaced laterally from the normal path of the roving 2. The bottom rolls are, in each case, driven by drive shafts extending along the spinning stations. A drive shaft 27 (FIG. 2), accordingly, drives the bottom feed roll 18.

Referring to FIG. 1, in the absence of yarn 4, the sensor 9 which is disposed at a suitable place between the pair of delivery rolls 23 and the ring rail 6 transmits a signal indicative of a break in the roving delivered from the drafting frame 3 to the robot 11. Thereupon, the carriage 12 moves to a position in front of the associated spinning station or drawing frame 3. At the same time, a signal is fed via a line 28 from the sensor 9 to a clamping device which, as considered in the direction of roving motion indicated by arrow 29, precedes the drafting frame 3. As indicated, the clamping device includes a trumpet or roving guide 30 and a plug 32 for positioning an end part of the roving at a reference point 33 upstream of the drafting frame 3. When the signal has been given, the plug 32 is pressed in the direction of arrow 31 into the conically converging surface of the trumpet 30 to clamp the roving 2. There is no need for a more detailed description of a clamping device of this kind here, since it is already known, for example, from DE-PS No. 2 816 807. The roving 2 is torn apart or severed immediately after the trumpet 30 in the direction of motion of the roving 2 by the drawing force or tension exerted by the pair of rolls 17, 18. This location is the reference or take-up point 33. The robot carriage 12 carries a movable arm 38 which, in turn, carries a gripper 3 to engage the end part of the roving at the reference point 33. The arm 38 serves to move the gripper 34 between the reference point 33 and a central discharge point 40 immediately upstream of the main drafting zone 16. After engaging the end part 37 at reference point 33 and after the clamping device 30 has been unlocked or released by the robot 11, the gripper 34 performs a programmed three-dimensional movement whereby the end part 37 is brought into the central discharge point 40 immediately in front of the main drafting zone 16, in such a manner that the end part 37 passes into the nip of the middle pair of rolls 21 and is thus engaged thereby. In this movement of the gripper 34, the preliminary drafting zone 15 is effectively bypassed, i.e. the portion of roving situated between the pair of feed rolls 17, 18 and the middle pair of rolls 21 is not subjected to drafting.

A means is also provided in the form of a spacer 41 for feeding the roving between the reference point 33 and the discharge point 40 to the free end face 26 of the top feed roll 17. As shown, in FIGS. 2 and 4 the spacer 41 is spaced laterally from the normal path of roving and is in the form of a hook.

The travel of the gripper 34 laterally bypasses the top feed roll 17, i.e. the gripper 34 goes past the free end face 26, and at the same time passes through the range of engagement of the spacer 41 (FIG. 2, 4), which keeps the roving spaced from the free end face 26 until the roving is engaged by the middle pair of rolls 21, in order to avoid premature contact between the roving 2 and the feed rolls 17, 18. This position of the part of the roving situated between the main drafting zone 16 and the reference point 33 is denoted by reference 2.1. The horizontal position of the roving in position 2.1 should be as close as possible to the extension of the nip of the feed rolls 17, 18, but must definitely be below the axis of rotation of the top feed roll 17.

Figure 4:
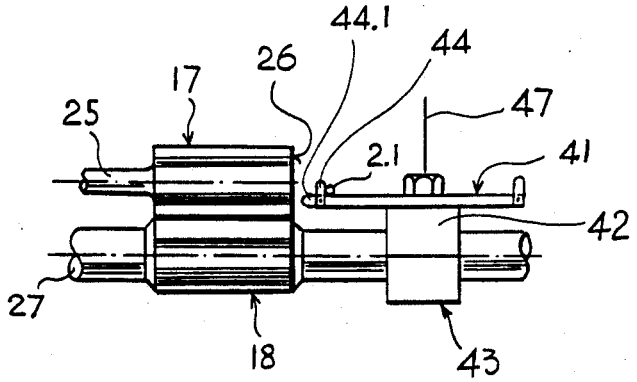
FIG. 4 illustrates a view taken on line IV—IV of FIG. 2.

The hook 41, in duplicate, is mounted on the top half 42 of a bearing housing 43 for the bottom feed roll 18 between two pairs of top rolls 17, 20. If there is no bearing housing 43, the hook 41 is mounted on any other support. As shown in FIG. 4, an upright retaining limb 44 of the hook 41 is pivotable to move between a blocking position to hold the roving in position 2.1 spaced from the feed rolls 17, 18 and a release position to permit the roving to move to the face 26 of the top feed roll 17. This limb 44 is adapted to be flipped over by means of an electric or pneumatic pulse which originates from the carriage 12 via a stationary contact 46 (FIG. 1) and which is fed via a line 47. The triggering pulse to the hook 41 (the flipped-over position of the retaining limb has the reference 44.1) is given as soon as the end part 37 has been introduced into the main drafting zone 16, i.e. has been engaged by the middle pair of rolls 21, so that the roving slides or is drawn out of position 2.1 by the hook 41 and gradually, without further actuation, passes laterally between the top feed roll 17 and the bottom feed roll 18 as a result of tightening due to the drawing force or tension exerted by the main drafting zone 16. Tightening takes place between two fixed reference points. One of these is the nip in the middle pair of rolls 21 and the other reference point is the trumpet 30, from which the plug 32 has been disengaged in the meantime and in which the roving 2 is subjected to a reaction force produced by friction at the roving bobbin 1. Tightening results in centering of the roving 2 on the intended trajectory in the drafting frame 3, as denoted by reference 2.3 in FIG. 2. In plan view the trajectory 2.3 is situated centrally on the bottom rolls, but is subjected to parallel reciprocation in known manner as a result of the movement of a traversing bar 50 on which the trumpet or roving guide or clamping device 30 is fixed. The middle discharge point 40 thus refers to this parallel zone.

FIG. 2 shows an alternative clamping device 54 which, as considered in the direction of roving movement, is located in front of a trumpet 52 shown individually in FIG. 3, and comprises a fixed jaw 55 and a rockable jaw 57 movable in direction of arrow 56. Unlike the trumpet 30, the trumpet 52 has a continuous slot 59. The top part of the trumpet 52 adjacent the slot 59 is bent substantially tangentially at its entry end and forms a projecting tab 60. The roving guide may also be bent from wire, for example as shown in DE-OS No. 3 532 422, in which the limb ends are so bent that the roving 2 can be introduced laterally but cannot slip out in normal operation.

The gripper 34 engages the end part 37 at reference point 33 immediately after the clamping device 54 and feeds the end part to the discharge point 40. The roving 2 is brought in a single movement through the slot 59 of the trumpet 52 into the initial position shown by the broken line 2.1, despite the fact that there is usually a kink in the roving 2 at the trumpet 52. This is because the roving 2 is hooked by the tab 60 during the movement of the gripper 34 between the reference point 33 and the discharge point 40 so that the roving 2 is automatically centered in the trumpet 52. This situation is shown particularly clearly in FIG. 5. Tightening of the roving causes that part thereof which is situated at clamping device 54 between the main drafting zone 16 and the reference point 33 to pass, via an intermediate position 2.2, into the centered position in accordance with the trajectory 2.3, the above-mentioned reference points again being the middle pair of rolls 21 and the roving bobbin 1.

The pivotable arm 38 is shown in solid lines in FIG. 1 and by way of indication in FIG. 2 in the position in which it engages the end part 37. The broken lines bearing the reference 38.1 illustrate its discharge position.

Referring to FIG. 5, a stationary robot 63 is associated with each spinning station and has a universally pivotable telescopic arm 64 to engage the end part 37 and is movable to the discharge position 64.1. The Arm 64 is secured on the textile machine at a suitable point above the drafting frame 3 by means of a ball joint 67. Both the telescopic longitudinal movement and the rocking movement can be controlled pneumatically or by means of racks. In this embodiment the sensor 9 (not shown) gives commands to the clamping device 54 and also activates the arm 64 so that if a mobile robot is provided it can be relieved. Of course, a three-dimensional movement programmed to be reversely identical is provided for an operation on the feed roll 17.

Referring to FIGS. 5 and 6, the means for feeding the roving to the free end face 26 of the top feed roll 17 is in the form of a pusher which cooperates with the arm 64 which, in this embodiment, has a two-dimensional movement so that there is a joint pin instead of the ball joint 67. A simplification can, in some cases, be obtained in terms of control technology by providing two consecutive method steps in which there are only two-dimensional movements taking place. Accordingly, the telescopic arm 64 during a first step guides the end part 37 from the reference point 33 to the discharge point 40 over the outer surface 70 of the top feed roll 17 and the trumpet 52 and thus remains in the imaginary plane formed by the roving 2 (at the clamping device 54) and yarn 4 (at the pair of delivery rolls 23). This position of the roving is marked by reference 2.4. The second step in the process is effected immediately after engagement of the end part 37 by the middle pair of rolls 21, that part of the roving 2 which is situated between the reference point 33 and the discharge point 40 being laterally shifted in the direction of arrow 75 on receipt of a signal from the robot 63, the shifting operation being effected by the pusher in the form of a rockable stirrup 73, which also performs only a two-dimensional movement. The stirrup 73 has two curved limb ends 78, 79 which join to form an articulated shank part 80. The limb ends 78, 79 have a curvature such that when the roving is shifted in the direction of arrow 75, it slides over them. In the discharge position 73.1 of the stirrup the roving passes into a position 2.5 similar to position 2.1. The object of two ends 78, 79 is to simplify guidance, particularly if the roving is simultaneously to be pushed over the tab 60.

The telescopic arms 64 can also perform the function of the stirrup 73 by performing two successive two-dimensional movements. The telescopic arm 64 and the rockable stirrup 73 may also be located on the carriage 12. The pivotable arm 38 can also perform a two-dimensional movement as an alternative. Many combinations are possible.

The gripper 34 operates immediately after the clamping point or clamping device 30, 54 and is of a length in the direction of roving motion such that, taking into account the minimum staple length of the silver or roving 2, there is a sufficiently long free tuft length for the attenuated end part 37 to be engaged by the middle pair of rolls 21. In this respect, one of the two gripper fingers may be in the form of a driven roll so that the free length of the end part 37 can be enlarged if necessary.

Referring to FIG. 7, the means for feeding the roving to the free end face 26 of the top feed roll 17 may also be a fixed or immovable slider in the form of a sliding stirrup 84 secured in duplicate, e.g. by screws 85 or the like to the traversing bar 50 for sliding of the roving thereon and therefrom laterally to the end face 26 of the top feed roll 17. Referring to the right-hand half (the left-hand half is reversely identical), the sliding stirrup 84 has an upright part 86 and a part 88 which extends forwards at an angle from the top end of the part 86. The free end 89 is situated at the free end face 26 near the nip of the feed rolls 17, 18. The gripper 34 engages the end part 37 immediately after the trumpet 30 and brings the roving 2 into the position 2.4, the roving 2 being situated above the part 88. The tension of the main drafting zone now first draws the roving 2 over part 88 on to the free end face 26 and then laterally between the feed rolls 17, 18.

The method described above is intended more particularly for the automatic resumption of spinning in, for example, ring, nozzle and rewind spinning machines after a yarn breakage. However, the method can also be used for automatic attachment of a roving end to a new roving bobbin 1. To this end, it is possible to use a readiness position which engages the new roving end and which then acts as a reference point. In that a case, a sensor 9 can monitor the roving unwinding from the roving bobbin 1.

What is claimed is:

1. A method of introducing a roving into a textile machine drafting frame comprising the steps of taking up an end part of the roving at a reference point upstream of a drafting frame having a preliminary drafting zone and a downstream main drafting zone;

introducing the taken-up end part of the roving into said main drafting zone while by-passing the roving about said preliminary drafting zone;

thereafter drawing the roving into said main drafting zone while imparting tension in the roving upstream of said main drafting zone to cause a lateral introduction of the roving between said reference point and said main drafting zone into said preliminary drafting zone.

2. A method as set forth in claim 1 wherein said preliminary drafting zone includes at least a top feed roll for feeding roving therethrough and wherein said end part of the roving bypasses the top feed roll laterally during movement from said reference point to said main drafting zone.

3. A method as set forth in claim 1 wherein said preliminary drafting zone includes at least a top feed roll for feeding roving therethrough and wherein said end part of the roving bypasses an outer surface of the top feed roll and the remainder of the roving between said reference point and said main drafting zone is brought to a side of the top feed roll.

4. A method as set forth in claim 3 wherein said lateral introduction of the roving into said preliminary drafting zone occurs automatically after bringing of the roving to the side of the top feed roll.

5. A textile machine comprising at least one drafting frame having a preliminary drafting zone including at least one top feed roll and a bottom feed roll and a main drafting zone;

a clamping device for positioning an end part of a roving at a reference point upstream of said drafting frame;

a sensor for emitting a signal in response to a break in the roving delivered from said drafting frame;

a robot responsive to said signal, said robot including a gripper to engage the end part of the roving at said reference point and a movable arm connected to said gripper to move said gripper between said reference point and a central discharge point immediately upstream of said main drafting zone; and means for feeding the roving between said points to a free end face of said top feed roll.

6. A textile machine as set forth in claim 5 wherein said arm is movable in three-dimensions and wherein said means includes a spacer situated adjacent said free end face of said top feed roll in a path of movement of said gripper from said reference point to said discharge point for engagement of the roving with said spacer, said robot being connected with said spacer to transmit a triggering signal to said spacer for release of the roving therefrom in response to introduction of said end part of the roving into said main drafting zone.

7. A textile machine as set forth in claim 6 wherein said spacer is a pivotally mounted hook movable between a blocking position to hold a roving spaced from said top feed roll and a release position to permit the roving to move to said top feed roll.

8. A textile machine as set forth in claim 5 wherein said arm is pivotably movable to pass said gripper over an outer surface of said top feed roll during movement from said reference point to said discharge point and wherein said means includes pusher for feeding the roving laterally to said free end face of said top feed roll, said robot being connected to said pusher to activate said pusher in response to introduction of said end part of the roving into said main drafting zone.

9. A textile machine as set forth in claim 8 wherein said pusher is a rockable stirrup having a pair of curved limbs for selective sliding of a roving thereon.

10. A textile machine as set forth in claim 5 wherein said arm is pivotably movable to pass said gripper over an outer surface of said top feed roll during movement from said reference point to said discharge point and wherein said means includes fixed slider for sliding of the roving thereon and therefrom laterally to said free end face of said top feed roll after introduction of said end part of the roving into said main drafting zone.

11. A textile machine as set forth in claim 5 wherein said clamping device includes a trumpet-shaped guide for guiding of the roving therethrough.

12. A textile machine as set forth in claim 5 wherein said clamping device includes a trumpet-shaped guide having a longitudinally disposed slot for passage of a roving laterally therethrough and a tab extending tangentially over said slot at an upstream end.

13. A textile machine as set forth in claim 5 wherein said robot is movable along said drafting frame.

14. A textile machine as set forth in claim 5 wherein said robot is stationarily mounted in alignment with said drafting frame.

15. A textile mache as set forth in claim 5 wherein said movable arm of said robot is telescopically adjustable along a longitudinal axis thereof.

* * * * *

UNITED STATES PATENT AND TRADEMARK OFFICE

CERTIFICATE OF CORRECTION

PATENT NO. : 4,922,704

DATED : May 8, 1990

INVENTOR(S) : WALTER SLAVIK, et al

It is certified that error appears in the above-identified patent and that said Letters Patent is hereby corrected as shown below:

Column 4, line 10, "easily engages" should be -- easily overcomes any kink in the roving trajectory due to the tab which engages-

Signed and Sealed this

First Day of October, 1991

*Attest:*

*Attesting Officer*

HARRY F. MANBECK, JR.

*Commissioner of Patents and Trademarks*